US010252262B2

(12) United States Patent
Colin et al.

(10) Patent No.: US 10,252,262 B2
(45) Date of Patent: Apr. 9, 2019

(54) SAMPLE TEST CARDS

(71) Applicant: bioMerieux, Inc., Durham, NC (US)

(72) Inventors: Bruno Colin, Marcy l'Etoile (FR); Raymond O'Bear, Granite City, MO (US); Cecile Paris, Bessenay (FR)

(73) Assignee: BIOMERIEUX, INC., Durham, NC (US)

( * ) Notice: Subject to any disclaimer, the term of this patent is extended or adjusted under 35 U.S.C. 154(b) by 0 days.

(21) Appl. No.: 15/666,214

(22) Filed: Aug. 1, 2017

(65) Prior Publication Data

US 2018/0021770 A1 Jan. 25, 2018

Related U.S. Application Data

(63) Continuation of application No. 13/267,158, filed on Oct. 6, 2011, now Pat. No. 9,757,723.
(Continued)

(51) Int. Cl.
*B01L 3/00* (2006.01)

(52) U.S. Cl.
CPC ..... *B01L 3/5025* (2013.01); *B01L 3/502723* (2013.01); *B01L 3/523* (2013.01); *B01L 3/527* (2013.01); *B01L 2200/025* (2013.01); *B01L 2200/027* (2013.01); *B01L 2200/141* (2013.01); *B01L 2200/143* (2013.01);
(Continued)

(58) Field of Classification Search
CPC ..... B01L 2200/025; B01L 2200/027; B01L 2200/141; B01L 2200/143; B01L 2300/044; B01L 2300/0654; B01L 2300/0816; B01L 2300/0829; B01L 2300/0864; B01L 2300/087; B01L 2300/0893;
(Continued)

(56) References Cited

U.S. PATENT DOCUMENTS 3,957,583 A 5/1976 Gibson et al.
3,963,355 A 6/1976 Aldridge et al.
(Continued)

FOREIGN PATENT DOCUMENTS

AU 722698 B2 8/2000
WO WO 2009/121037 A2 10/2009

OTHER PUBLICATIONS

International Search Report and Written Opinion for Application No. PCT/US11/55078 dated Apr. 27, 2012.
(Continued)

*Primary Examiner* — Samuel P Siefke
(74) *Attorney, Agent, or Firm* — Alston & Bird LLP

(57) ABSTRACT

The present invention is directed to sample test cards having an increased sample well capacity for analyzing biological or other test samples. In one embodiment, the sample test cards of the present invention comprise one or more fluid over-flow reservoirs, wherein the over-flow reservoirs are operatively connected to a distribution channel by a fluid over-flow channel. In another embodiment, the sample test cards may comprise a plurality of flow reservoirs operable to trap air thereby reducing and/or preventing well-to-well contamination. The test card of this invention may comprise from 80 to 140 individual sample wells, for example, in a test card sample test cards of the present invention have a generally rectangular shape sample test card having dimensions of from about 90 to about 95 mm in width, from about 55 to about 60 in height and from about 4 to about 5 mm in thickness.

26 Claims, 3 Drawing Sheets

Related U.S. Application Data

(60) Provisional application No. 61/391,236, filed on Oct. 8, 2010.

(52) U.S. Cl.
CPC . *B01L 2300/044* (2013.01); *B01L 2300/0654* (2013.01); *B01L 2300/087* (2013.01); *B01L 2300/0816* (2013.01); *B01L 2300/0829* (2013.01); *B01L 2300/0864* (2013.01); *B01L 2300/0893* (2013.01); *B01L 2400/049* (2013.01)

(58) Field of Classification Search
CPC ..... B01L 2400/049; B01L 3/5025; B01L 3/502723; B01L 3/523; B01L 3/527
See application file for complete search history.

(56) References Cited

U.S. PATENT DOCUMENTS

| | | | |
|---|---|---|---|
| D243,542 | S | 3/1977 | Fadler et al. |
| D243,543 | S | 3/1977 | Fadler et al. |
| 4,038,151 | A | 7/1977 | Fadler et al. |
| 4,116,775 | A | 9/1978 | Charles et al. |
| 4,118,280 | A | 10/1978 | Charles et al. |
| D254,687 | S | 4/1980 | Fadler et al. |
| 4,318,994 | A | 3/1982 | Meyer et al. |
| 4,806,316 | A | 2/1989 | Johnson et al. |
| 5,340,747 | A | 8/1994 | Eden |
| 5,374,395 | A | 12/1994 | Robinson et al. |
| 5,609,828 | A | 3/1997 | O'Bear et al. |
| D382,647 | S | 8/1997 | Staples et al. |
| 5,746,980 | A | 5/1998 | O'Bear et al. |
| 5,762,873 | A | 6/1998 | Fanning et al. |
| 5,766,553 | A | 6/1998 | Staples et al. |
| 5,856,193 | A | 1/1999 | Fanning et al. |
| 5,869,005 | A | 2/1999 | O'Bear et al. |
| 5,888,455 | A | 3/1999 | Seaton et al. |
| 5,891,396 | A | 4/1999 | Karl et al. |
| 5,932,177 | A | 8/1999 | O'Bear et al. |
| D414,272 | S | 9/1999 | O'Bear et al. |
| 5,951,952 | A | 9/1999 | O'Bear et al. |
| 5,965,090 | A | 10/1999 | Fanning et al. |
| 6,024,921 | A | 2/2000 | Freiner et al. |
| 6,045,758 | A | 4/2000 | Staples et al. |
| 6,086,824 | A | 7/2000 | Fanning et al. |
| 6,136,270 | A | 10/2000 | Maes et al. |
| 6,156,565 | A | 12/2000 | Maes et al. |
| 6,485,690 | B1 | 11/2002 | Pfost et al. |
| 7,601,300 | B2 | 10/2009 | Blanton et al. |
| D689,780 | S | 9/2013 | O'Bear et al. |
| D689,781 | S | 9/2013 | O'Bear et al. |
| D689,782 | S | 9/2013 | O'Bear et al. |
| D690,216 | S | 9/2013 | O'Bear et al. |
| D714,172 | S | 9/2014 | O'Bear et al. |
| 2003/0180191 | A1 | 9/2003 | Suzuki et al. |
| 2004/0206408 | A1 | 10/2004 | Peters et al. |
| 2005/0048597 | A1 | 3/2005 | Smith et al. |
| 2007/0014695 | A1 | 1/2007 | Yue et al. |
| 2008/0257754 | A1 | 10/2008 | Pugia et al. |
| 2012/0088263 | A1 | 4/2012 | Bruno et al. |
| 2012/0141325 | A1 | 6/2012 | O'Bear et al. |

OTHER PUBLICATIONS

International Search Report and Written Opinion for Application No. PCT/US11/61893 dated Mar. 29, 2012.

SAMPLE TEST CARDS

CROSS REFERENCE TO RELATED APPLICATIONS

This application is a continuation of U.S. application Ser. No. 13/267,158, entitled, "Sample Test Cards", filed Oct. 6, 2011, which application claims the benefit of U.S. Provisional Patent Application No. 61/391,236, entitled, "Improved Sample Test Cards", filed Oct. 8, 2010, each of which is incorporated by reference herein in its entirety.

FIELD OF THE INVENTION

The invention relates to improved sample test cards, which have an increased sample well capacity for analyzing biological or other samples.

BACKGROUND OF THE INVENTION

Sample test cards have been used to analyze blood or other biological samples in a spectroscopic or other automated reading machine. Such machines receive a small test card, roughly the size of a playing card, in which biological reagents, nutrients or other material is deposited and sealed, prior to injection of patient samples.

The test card contains the reagents and receives the patient samples in a series of small wells, formed in the card in rows and columns and sealed, typically with tape on both sides. The test cards are filled with patient sample material through fine hydraulic channels formed in the card. The microorganisms in the samples may then be permitted to grow or reactions to proceed, generally over a period of up to a few hours, although the period varies with the type of bacteria or other substance analyzed and sample used.

The current assignee has commercialized instruments for fast, accurate microbial identification, and antimicrobial susceptibility testing (e.g., Vitek® 2 and Vitek® Compact). These instruments include an incubation stations that maintains sample test cards at a precisely controlled temperature to enhance microorganism growth in the individual sample wells. The incubation station includes a rotating carousel that has a plurality of slots for receiving test sample cards. The carousel is vertically mounted and rotates about a horizontal axis. This rotation about the horizontal axis during incubation causes the test card to be rotated through 360° from a normal "upright" card position, through an "inverted" or "upside-down" card position and then back again to an "upright" position. After the incubation, the samples contained in the wells are placed in front of a laser, fluorescent light or other illumination source. The content of the sample in a given well can then be deduced according to readings on the spectrum, intensity or other characteristics of the transmitted or reflected radiation, since the culture of different bacteria or other agents leave distinctive signatures related to turbidity, density, byproducts, coloration, fluorescence and so forth. The instruments for reading the test cards and the incubation carousel are further described in U.S. Pat. Nos. 5,762,873; 5,888,455; 5,965,090; 6,024,921; 6,086,824; 6,136,270; 6,156,565; and 7,601,300, the contents of which are incorporated herein by reference herein.

Despite the general success of test cards in this area, there is an ongoing desire to improve the performance of the cards and readings on their samples. It is for example an advantage to impress more reaction wells in a given card, so that a greater variety of reactions and therefore discrimination of samples can be realized. A given facility may have only one such machine, or be pressed for continuous analysis of samples of many patients, as at a large hospital. Conducting as many identifying reactions on each sample as possible is frequently desirable, yielding greater overall throughput.

It has also been the case that as the total number of reaction wells on a given card has increased, while the card size has remained constant, the wells have necessarily been formed increasingly close together. With the sample wells crowding each other on the card, it has become more likely that the sample contained in one well can travel to the next well, to contaminate the second well. The threat of increased contamination comes into play especially as card well capacity increases above 30 wells.

The current Vitek® 2 disposable product family uses a sample test card containing 64 individual sample wells into which chemicals can be dispensed for the identification and susceptibility testing of microorganisms in the diagnosis of infectious disease. Each of the fill channels of the 64 well test card descend to and enter sample wells at an angle, which results in the natural flow of the sample fluid down through the fill channels by gravity, and resistance to small pieces of undissolved material flowing back up into the fluid circuitry. The fluid flow paths are thoroughly dispersed over the card, including both front and rear surfaces, also result in a longer total linear travel of the flowing fluid than conventional cards. The increased well-to-well distance leads to a reduction in the possibility of inter-well contamination. The average well-to-well distance of fluid flow channels on the 64 well card is to approximately 35 mm, significantly more than the 12 mm or so on many older card designs. The 64 well test card is further described, for example, in U.S. Pat. Nos. 5,609,828; 5,746,980; 5,869,005; 5,932,177; 5,951,952; and USD 414,272, the contents of which are incorporated herein by reference herein.

As previously discussed, the incubation carousel employed in the Vitek® 2 and Vitek® compact instruments rotates the test cards through a 360° rotation from a normal "upright" card position, through an "inverted" or "upside-down" card position and then back again to an "upright" position. This rotation of the card can lead to leaking of the sample well contents into the fill channels of prior art cards like the 64 well card where the fill channels descend to and enter sample wells at an angle. In the case of the 64 well card, the potential for well-to-well contamination is still mitigated by the large distance between wells. However, this requirement for longer distances between the wells limits the total number of wells that can fit on a test card of standard size.

In the case of identification, the use of 64 reactions wells tends to be sufficient. However, employing only 64 wells in determining antibiotic susceptibility is limiting. Increasing the number of wells in the card would allow improved performance by using more wells for a single antibiotic test as well as increase the number of antibiotics that could be evaluated in a single card. Accordingly, there is a need to increase the total well capacity in a standard test card while maintaining the reduction in the possibility of inter-well contamination. The novel test cards disclosed herein satisfy this goal without requiring significant changes to instruments designed to read each well during incubation.

SUMMARY OF THE INVENTION

We disclose herein multiple design concepts for novel sample test cards that provide an increase in the total number of sample wells contained within a test card of standard dimensions. These designs concepts are capable of delaying/ preventing chemicals from migrating from one well to another during card filling and incubation, thereby reducing potential contamination between wells.

In one embodiment, a sample test card is provided comprising: (a) a card body defining a first surface and a second surface opposite the first surface, a fluid intake port and a plurality of sample wells disposed between the first and second surfaces, the first and second surfaces sealed with a sealant tape covering the plurality of sample wells; (b) a fluid channel network disposed on the first surface and connecting the fluid intake port to the sample wells, the fluid channel network comprising at least one distribution channel, a plurality of fill channels operatively connected to the at least one distribution channel, and (c) one or more over-flow reservoirs, the over-flow reservoirs being operatively connected to the distribution channel by a fluid over-flow channel. The test card of this embodiment may comprise from 80 to 140 individual sample wells, or from about 96 to about 126 individual sample wells, each of which receives a test sample, for example a biological sample extracted from blood, other fluids, tissue or other material of a patient, for spectroscopic or other automated analysis. In other design variations, the sample test card in accordance with this embodiment may comprise 80, 88, 96, 104, 108, 112, 120, 126, 135 or 140 individual sample wells.

In one embodiment, the present invention is directed to an improved sample test card being about 90 mm in width, about 56 mm in height and about 4 mm thick, having a substantially flat card body with a first surface and a second surface opposite to the first surface, an intake port formed in the card body, a plurality of sample wells formed in the card body, and a fluid flow distribution channel operatively connected to the intake port and traversing a portion of the first surface to distribute a fluid sample from the intake port to the sample wells thereby supplying fluid test samples to the sample wells, wherein the improvement comprises the test card having from about 80 to about 140 total sample wells.

In still another embodiment, a sample test card is provided comprising: (a) a card body defining a first surface and a second surface opposite the first surface, a fluid intake port and a plurality of sample wells disposed between the first and second surfaces, the first and second surfaces sealed with a sealant tape covering the plurality of sample wells; (b) a fluid channel network connecting the fluid intake port to the sample wells, the fluid channel network comprising a single distribution channel disposed on the first surface, the single distribution channel providing a fluid flow path from the fluid intake port to each of the sample wells, and wherein the distribution channel further comprises a plurality of flow reservoirs (e.g., diamond shaped reservoirs) contained within the distribution channel, each of the flow reservoirs having one or more fill channels, wherein the fill channels operatively connect the flow reservoir to the sample wells. In one design configuration, the flow reservoirs are operable as an air trap or air lock to prevent well-to-well contamination. For example, after loading of a test sample into the test sample card, the distribution channel can be filled with air (e.g., by aspirating air into the sample test card via the fluid intake port), and the flow reservoirs can act to trap air, thereby acting as a air barrier, or lock, preventing well-to-well contamination. The test card of this embodiment may further comprise one or more over-flow reservoirs, wherein the over-flow reservoirs are operatively connected to the distribution channel downstream from the sample wells by an over-flow channel. The test card of this embodiment may comprise from 80 to 140 individual sample wells, or from about 96 to about 126 individual sample wells. In other design variations, the sample test card in accordance with this embodiment may comprise 80, 88, 96, 104, 108, 112, 120, 126, 135 or 140 individual sample wells.

In yet another embodiment, the present invention is directed to a method for filling a test sample card with a test sample, the method comprising the following steps of: a) providing a test sample containing or suspected of containing an unknown microorganism; b) providing a sample test card comprising a card body defining a first surface and a second surface opposite the first surface, a fluid intake port and a plurality of sample wells disposed between the first and second surfaces, wherein the first and second surfaces are sealed with a sealant tape covering the plurality of sample wells, a fluid channel network connecting the fluid intake port to the sample wells, the fluid channel network comprising at least one distribution channels and a plurality of fill channels operatively connecting the at least one distribution channel to the sample wells, and one or more over-flow reservoirs operatively connected to the distribution channel by a fluid over-flow channel, and wherein the sample test card comprises from about 80 to about 140 total sample wells; c) filling or loading said test sample into said sample test card via said fluid intake port; wherein said plurality of sample wells are substantially filled with said test sample; and (d) subsequently substantially filling said fluid flow channel network with air or a non-aqueous liquid via said fluid intake port to reduce and/or prevent well-to-well contamination. In accordance with this embodiment, the total volume of the test sample loaded is more than the aggregate or cumulative total volume of all of the sample wells, and less than the total aggregate or cumulative volume of said sample wells, said fluid channel network and said one or more over-flow reservoirs. Furthermore, in accordance with this embodiment, the aspiration of air into the sample test card fills the fluid channel network with air and/or allows any excess fluid to flow into, or be captured by, the over-flow reservoirs.

BRIEF DESCRIPTION OF THE FIGURES

The various inventive aspects will become more apparent upon reading the following detailed description of the various embodiments along with the appended drawings, in which.

DETAILED DESCRIPTION OF THE INVENTION

Figure 1:
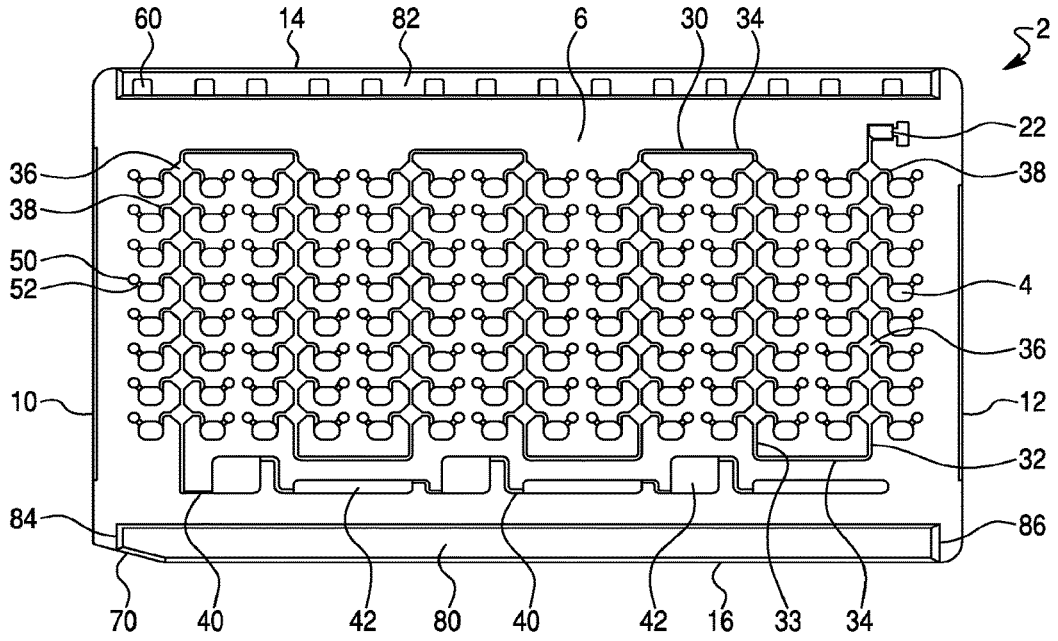
FIG. 1—is a front view of the front surface of a sample test card, in accordance with one design concept of the present invention. As shown, the sample test card comprises 112 sample wells, an intake reservoir, a main distribution channel and a plurality of well ports.

The improved sample test cards of the present invention have a generally rectangular shape and are typically in standard dimensions of from about 90 to about 95 mm in width, from about 55 to about 60 mm in height and from about 4 to about 5 mm in thickness. In one embodiment, the sample test cards of the present invention are about 90 mm wide, about 56 mm high and about 4 mm thick. The test cards of this invention may comprise from 80 to 140 individual sample wells, or from about 96 to about 126 individual sample wells, each of which receives a test sample, for example a biological sample extracted from blood, other fluids, tissue or other material of a patient, for spectroscopic or other automated analysis. In other embodiments, the sample test cards may comprise 80, 88, 96, 104, 108, 112, 120, 126, 135 or 140 individual sample wells. The sample wells are typically arranged in a series of horizontal rows and vertical columns and may comprise from about 8 to about 10 rows of from about 10 to about 16 columns of wells. The biological sample may be a direct sample from the patient, or be a patient sample which is extracted, diluted, suspended, or otherwise treated, in solution or otherwise. The sample test cards of the present invention are generally used in a landscape orientation.

The test cards may be made of polystyrene, PET, or any other suitable plastic or other material. The test cards may be tempered during manufacture with a softening material, so that crystalline rigidity, and resultant tendency to crack or chip, is reduced. Test cards for instance may be manufactured out of a blend of polystyrene, approximately 90% or more, along with an additive of butyl rubber to render the card slightly more flexible and resistant to damage. In some embodiment, the test cards may also be doped with coloring agents, for instance titanium oxide to produce a white color, when desired.

The test cards of the invention may be of use in identifying and/or enumerating any number of microorganisms, such as bacterial and/or other biological agents. Many bacteria lend themselves to automated spectroscopic, fluorescent and similar analysis after incubation, as is known in the art. The transmission and absorption of light is affected by the turbidity, density and colormetric properties of the sample. Fluorescent reactions may be performed as well, independently or along with spectroscopic or other measurements. If fluorescent data are gathered, use of a coloring agent in test cards may be preferred, since an opaque card reduces or eliminates the scattering of fluorescent emissions throughout the card, as can occur with a translucent material. Other types of detection and analysis can be done on the test cards, including testing of susceptibility of microorganisms to antibiotics of different types, and at different concentrations, so that the test cards are general-purpose.

In accordance with the present invention, the sample test card comprises a fluid channel network or a plurality of fluid flow channels (e.g., distribution channels and fill channels) for transport of a fluid test sample from an intake port to each of the individual sample wells. The distribution channels and fill channels (e.g., as schematically illustrated in FIGS. 1-2 and 7-8), may be preferably formed in full-radius style, that is, as a semicircular conduit, rather than a squared-off channel as in some older designs. The full-radius feature has been found by the inventors to reduce friction and fluid turbulence, further enhancing the performance of test card 2. Also, as shown for example in the Figures, the test cards of present invention further comprise one or more over-flow reservoirs, which can be connected to the distribution channel by an over-flow channel located downstream of the individual sample wells. As would be appreciated by those skilled in the art, the fluid over-flow reservoirs may comprise a variety of different shapes and sizes.

Applicants have discovered that the inclusion of one or more over-flow reservoirs on the test card allows the fluid flow path to be drained and/or filled with air, thereby creating an air barrier or air lock that reduces and/or prevents well-to-well contamination. Accordingly, by introducing an air barrier between sample wells, the long fluid flow paths between wells, required in previous card designs, can be decreased. The use of a shorter fluid flow path between wells allows for an increased well capacity within a test card having standard dimensions, while maintaining strict inter-well contamination standards. Furthermore, by reducing the well sizes of previous test card designs by approximately one-third, enough additional surface area may be recovered to allow for an even greater increase in well capacity in a test card having standard dimensions.

Furthermore, in accordance with the present invention, the test cards are typically designed to accommodate a specific liquid load volume (i.e., an inoculum or fill volume), while allowing excess volume capacity so that air can be aspirated into the card, thereby filling the fluid flow channels with air and provide an air barrier or air lock between sample wells. This excess volume capacity is provided by the over-flow reservoirs. In one embodiment, as would be appreciated by one of skill in the art, the total volume of the test sample loaded (i.e., the inoculum or fill volume) is more than the aggregate or cumulative total volume of all of the sample wells, and less than the total aggregate or cumulative volume of the sample wells, the fluid channel network and the one or more over-flow reservoirs. In another embodiment, the total volume of the test sample (i.e., inoculum or fill volume) is sufficient to fill all of the sample wells.

In another embodiment, the one or more over-flow reservoirs on the test card may allow the fluid flow path to be drained and filled with a non-aqueous fluid. In general any non-aqueous fluid can be used in the practice of this embodiment. For example, the non-aqueous fluid can be a fluid that would naturally separate from an aqueous fluid into separate and distinct phases, such as, for example, a mineral oil, an olefin (including polyolefins), an ester, an amide, an amine, a siloxane, an organosiloxane, an ether, an acetal, a dialkylcarbonate, or a hydrocarbon. In accordance with this embodiment, the non-aqueous fluid will act to reduce and/or prevent well-to-well contamination by reducing and/or preventing components (e.g., chemicals) contained in the test sample wells (an aqueous fluid) from diffusing, or otherwise leaking, out of the test sample wells due to the non-aqueous nature of the fluid contained in the fluid flow path. Accordingly, by introducing a non-aqueous liquid between sample wells, the long fluid flow paths between wells, required in previous card designs, can be decreased. The use of a shorter fluid flow path between wells allows for an increased well capacity within a test card having standard dimensions, while maintaining strict inter-well contamination standards. Furthermore, in accordance with this embodiment, the test cards are typically designed to accommodate a specific liquid load volume (i.e., an inoculum or fill volume), while allowing excess volume capacity so that a non-aqueous liquid can be filled into the card, thereby filling the fluid flow channels with the non-aqueous liquid and thereby reducing and/or preventing well-to-well contamination between sample wells. This excess volume capacity is provided by the over-flow reservoirs. In one embodiment, as would be appreciated by one of skill in the art, the total volume of the test sample loaded (i.e., the inoculum or fill volume) is more than the aggregate or cumulative total volume of all of the sample wells, and less than the total aggregate or cumulative volume of the sample wells, the fluid channel network and the one or more over-flow reservoirs. In another embodiment, the total volume of the test sample (i.e., inoculum or fill volume) is sufficient to fill all of the sample wells. As is well known in the art, a test sample can be loaded from a tube or container into the test card, for example, by aspiration from the tube or container (see, e.g., U.S. Pat. No. 5,762,873). A non-aqueous fluid can be added to the test sample prior to loading of the test sample into the test card. Due to the nature of the non-aqueous fluid, the aqueous test sample and non-aqueous fluid will naturally separate into separate layers within the tube or container, thereby allowing the aqueous test sample to be loaded from the tube or container into the test card first, and subsequently allowing for the loading of the separated non-aqueous fluid. Hereinbelow, the various embodiments of this invention are described in terms of an air barrier or air lock. However, one of skill in the art would readily appreciate, based on the teachings contained herein, that a non-aqueous liquid can be used (instead of air) to fill the fluid flow channels to create a barrier for reducing and/or preventing well-to-well contamination.

For example, in the illustrated embodiment of FIGS. 1-6, the sample wells 4 have an approximate volume of from about 14 to about 15 μL, thereby giving an aggregate sample well volume of from about 1.5 mL to about 1.7 mL. However, due to the volume of the fluid flow channels and air bubbles, in practice, the volume needed to fill every sample well on the card will typically range from about 2 mL to about 3 mL, or from about 2.25 mL to about 2.75 mL, or about 2.5 mL. As would be well understood by one of skill in the art, the depth and width of the fluid flow channels can be adjusted, and/or the volume of the over-flow reservoirs can be adjusted, to accommodate either a smaller or larger total inoculum. The precise inoculum loaded to the test card is not critical in the practice of the present invention.

Once the liquid test sample (i.e., inoculum) is loaded, air can be aspirated into the card via the fluid injection tip and intake port to purge and/or empty the fluid flow channels. This aspiration step allows the fluid flow channels to fill with air, thereby creating or providing an air barrier or air lock between the now filled sample wells. Any excess fluid in the fluid flow channels will be emptied into the over-flow reservoirs via the over-flow channel as a result of aspiration. In one embodiment, the aspiration of air into the sample test card fills the fluid channel network (i.e., the fluid flow channels) with air and/or allows any excess fluid to flow into, or be captured by, the over-flow reservoirs. In another embodiment, the total volume of air aspirated into said sample test card is sufficient to fill the fluid channel network (i.e., the fluid flow channels).

In some embodiments, aspiration may result in foaming or bubbling of the test sample as the sample is loaded into the test card. Accordingly, in the practice of the present invention, the use of an anti-foaming agent such as mineral oil may be used to prevent and/or reduce foaming. The anti-foaming agent can be added to the test sample itself prior to loading of the test sample card, or the anti-foaming agent may be included pre-packaged in the test card. Other anti-foaming agents useful in the practice of this invention are well known to those of skill in the art.

After intake of enough air to fill the fluid flow channels and provide an air barrier that prevents well-to-well contamination, a short segment of the sample tip can be pinched off or heat-sealed and left in place in intake port, acting as a sealing plug.

In yet another embodiment, the one or more over-flow reservoirs may contain an absorbent that absorbs excess fluid from the fluid flow channels and thereby helps to empty the fluid flow channels and provide an air barrier. The use of an adsorbent in the over-flow reservoir stimulates or enhances draining and/or adsorption of fluid or liquid from the fluid flow channels, and accordingly, allows the fluid flow channels to be filled with air (e.g., by aspiration). In one embodiment, the use of an adsorbent in the over-flow reservoirs may cause the tape to bulge or otherwise act to "push" the tape out on both sides of the test card. This bulging or pushing of the tape causes the volume of the adsorbent to increase, thereby further stimulating or enhancing emptying of the fluid flow channels. In yet another embodiment, the adsorbent can be a well known time delay adsorbent, such as, for example, Atofina HP100, or other well known time delay adsorbent. Time delay adsorbents swell after a slight time delay, typically in the presence of a liquid, thereby increasing their adsorption capabilities. Although not wishing to be bound by theory, in the practice of the present invention, it is believed that the use of a time delay adsorbent will allow the wells to fill properly before the time delayed adsorbent adsorbs any remaining liquid in the fluid flow channels. In generally, any known adsorbent can be used. For example, the adsorbent could be an adsorptive resin, a silica gel, a hydrogel, a molecular sieve, zeolite, or other adsorbents well known to those of skill in the art.

One design concept of the invention is illustrated in FIGS. 1-6. This design provides an improved sample test card 2, having a generally rectangular shape and in standard dimensions. The test card 2 further comprises a plurality of sample wells 4 and has a first or front surface 6 and a second or rear surface 8, opposite said front surface 6, a first or leading side edge 10, a second or trailing side edge 12, a top edge 14, and a bottom edge 16. The illustrated test card 2 of this embodiment (see, FIGS. 1-6) contains a total of 112 individual sample wells 4, which extend completely through the test card from the front surface 6 to the rear surface 8, and each of which are capable of receiving a test sample for analysis, as previously described. However, test cards of this design may comprise from 80 to 140 individual sample wells, or from about 96 to about 126 individual sample wells. In one embodiment, the sample test cards may comprise 80, 88, 96, 104, 108, 112, 120, 126, 135 or 140 sample wells. The sample wells are typically arranged in a series of horizontal rows and vertical columns and may comprise from about 8 to about 10 rows of from about 10 to about 16 columns of wells.

Also, as shown in FIG. 1, the test card employs a fluid flow path comprising a single distribution channel 30, a plurality of flow reservoirs 36 and a plurality of fill channels 34, which connect to, and fill, each of the individual sample wells 4 with a test sample. As shown, the flow reservoirs may be diamond shaped reservoirs 36 that operate as an air trap or air lock to reduce and/or prevent well-to-well contamination (as described in more detail herein). However, as one of skill in the art would appreciate, other configurations can be used as an air traps or air lock designs. For example, the flow reservoir may be square, rectangular, circular, oval or other similar shape. The test card further comprises a series or plurality of over-flow reservoirs 42, which are connected to the distribution channel 30 by an over-flow channel 40, which is located downstream of the individual sample wells 4. In operation, as the illustrated test card 2 is filled with a test sample and/or aspirated, any excess fluid flows into, or is captured by, these over-flow reservoirs 42. As the excess fluid is taken up or captured by the over-flow reservoirs 42, the distribution channel 30 and diamond shaped reservoirs 36 are filled with air, thereby providing an air barrier, or air lock, between the individual sample wells 4. In one embodiment, the over-flow channel 40 may comprises a fluid flow channel having a width of about 0.2 mm and a depth of about 0.2 mm (i.e., a cross section of approximately 0.16 $mm^2$). As it is important that each sample well 4 of the test card 2 be filled with the test sample, it is likewise important to restrict or slow fluid flow into the over-flow channels 40 until each sample well is filed. While not wishing to be bound by theory, it is believed that a reduction in cross section from the distribution channel 30 to the over-flow channel 40 will reduce or slow fluid flow into the over-flow reservoirs 42, thereby allowing the sample wells 4 to be filled.

To receive sample fluid, the test card 2 includes a sample intake plenum or port 18 (see FIG. 6), typically located on a perimeter edge (e.g., the second or trailing edge 16) in an upper right corner of the test card 2. The sample wells 4 of test card 2 contain dry biological reagents which are previously put in place in the sample wells 4, by evaporative, freeze-drying or other means. Each sample well 4 can hold a deposit of a different reagent that can be used for identifying different biological agents and/or for determining the antimicrobial susceptibility of different biological agents, as desired. The injected patient sample dissolve or re-suspend the dry biological reagents in each sample well 4 for analysis.

As is well known in the art, intake port 18 receives a fluid injection tip and related assembly (schematically illustrated as 20), through which the sample fluid or other solution which arrives to dissolve the biological reagents in each sample well 4 is injected, under a vacuum pulled on test card 2 (typically 0.7-0.9 PSIA), then released to atmospheric pressure. Injection port 18 includes a small intake reservoir 22 formed as a roughly rectangular hole through the test card 2, which receives incoming fluid, and acts as a fluid buffer. When the sample is injected into the card, a short segment of the sample tip can be pinched off or heat-sealed and left in place in intake port 18, acting as a sealing plug. After the test fluid (patient sample or other solution) enters the intake port 18 the fluid flows through a fluid flow path comprising a series of fluid flow channels (e.g., distribution channels and/or fill channels) for transport of a fluid test sample from the intake port 18 to each of the individual sample wells 4, as described in more detail hereinbelow.

As the test fluid (i.e., patient sample or other solution) enters intake port (not shown) it collects in intake reservoir 22 and travels along a single distribution channel 30 that leads away from the intake reservoir 22. The distribution channel 30 comprises a relatively long channel, which weaves across the front surface 6 of the test card 2 among a plurality of columns of sample wells 4. In the illustrated embodiment of FIG. 1, the test card comprises 112 sample wells arranged in seven sets of two columns (i.e., fourteen total columns), each column having eight vertically arranged sample wells. To provide a fluid flow path connecting to, and thus, filling, all of the sample wells, the distribution channel 30 comprises a plurality of alternating descending branches 32 and ascending branches 33 interconnected by a plurality traversing branches 34.

As shown, the distribution channel 30 extends first vertical down the front surface 6 of the test card 4 (or descending) away from (i.e., descending branch 32) the intake reservoir 22 and between a first set of two columns, each column comprising eight sample wells 4. At the bottom of the first set of two columns, the distribution channel 30 comprises a traversing branch 34, which transverses in a horizontal manner across the surface of the card to the bottom of a second set of two columns. The distribution channel 30 then extends vertically up (or ascends) the front surface 6 of the test card 2 (i.e., ascending branch 33) between the second set of two columns. At the top of the second set of two columns, the distribution channel 30 comprises a traversing branch 34, which traverses in a horizontal manner across the surface of the card to the top of a third set of two columns and then extends vertically down or descends down (i.e., descending branch 32) between the third set of two columns. This pattern of alternating descending 32 and ascending 33 branches of the distribution channel, interconnected with traversing channel branches 34, continues across the front surface 6 of the test card 2, thereby allowing the distribution channel 30 to weave between all the vertically arranged columns of sample wells on the test card 2. In the illustrated embodiment of FIG. 1, the distribution channel 30 comprises four descending channel branches 32 and three ascending branches 33, interconnected by six traversing channel branches 34, thereby providing a fluid flow path between seven sets of two columns, with each column comprising eight sample wells (i.e., 112 total sample wells). In one embodiment the distribution channel 130 may comprises a fluid flow channel having a width of about 0.5 mm and a depth of about 0.5 mm (i.e., a cross section of approximately 0.25 $mm^2$).

In accordance with this design configuration, the distribution channel 30 further includes a series of flow reservoirs (e.g., diamond shaped reservoirs) 36 at intervals along its length. The diamond shaped reservoirs 36 are generally located between columns of wells and may be slightly elevated above the sample wells 4. As shown in FIG. 1, each of the diamond shaped reservoirs 36 are tapped by two fill channels 38, each leading to an individual sample wells 4. In general, the fill channels 38 are short fluid flow connections between the diamond shaped reservoir 36 and the individual sample wells 4. The fill channels 38 (which can be kinked) may enter the wells in a horizontal manner, or as shown in FIG. 1, in a vertical manner. Accordingly, the diamond shaped reservoirs 36 and fill channels 38 provide a fluid flow connection between the distribution channel 30 and each of the individual sample wells 4, and operate to fill each of the individual sample wells 4. In operation, after the test card 2 is filled with a test sample and aspirated, the diamond shaped reservoirs act to trap an air bubble, thereby creating an air barrier or air lock that reduces and/or prevents well-to-well contamination. In one embodiment the diamond shaped reservoirs 36 may comprises a fluid reservoir of approximately 2 mm×2 mm and having a depth of about 0.4 mm (i.e., a volume of approximately 1.6 $mm^2$). The fill channels 138 may comprise a fluid flow channel having a width of about 0.2 to about 0.4 mm and a depth of about 0.3 to about 0.5 mm (i.e., a cross section of about 0.06 to 0.2 $mm^2$). In another embodiment, the fill channels 38 have a width of about 0.3 mm and a depth of about 0.4 mm (i.e., a cross section of about 0.12 $mm^2$).

Accordingly, the illustrated test card 2 (see FIG. 1) therefore provides a single distribution channel, which weaves among seven sets of two columns, each having eight vertically arranged sample wells 4 (i.e., 112 total sample wells). As shown in FIG. 1, the distribution channel further comprises fifty-six (56) diamond shaped reservoirs 36 each separately connected via fill channels 38 to two sample wells 4 (i.e., 112 total fill channels).

Figure 2:
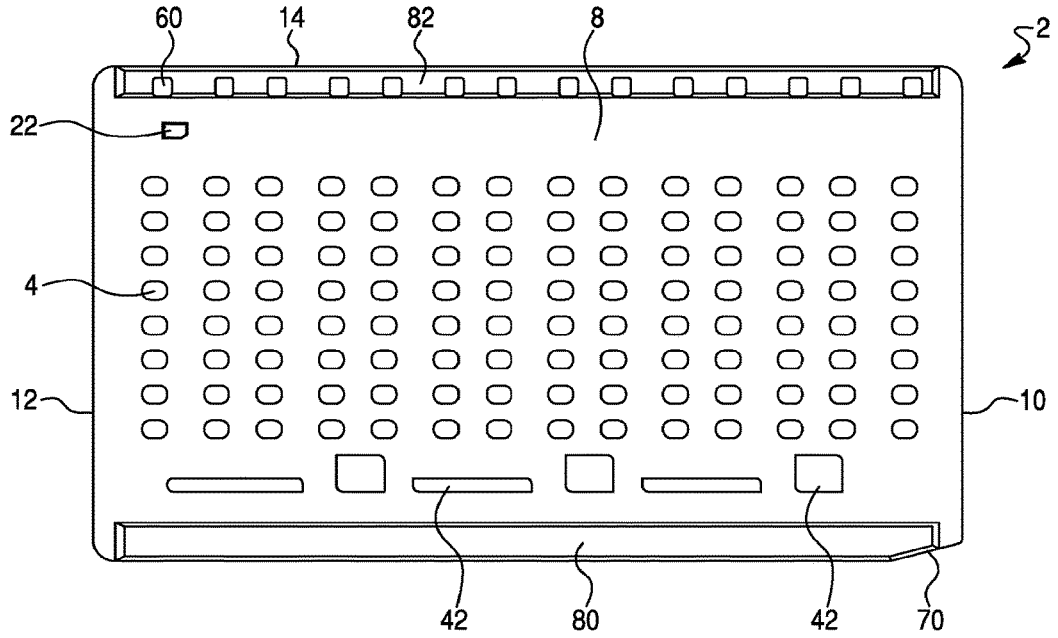
FIG. 2—is a front view of the rear surface of the sample test card shown in FIG. 1.
Figure 3:
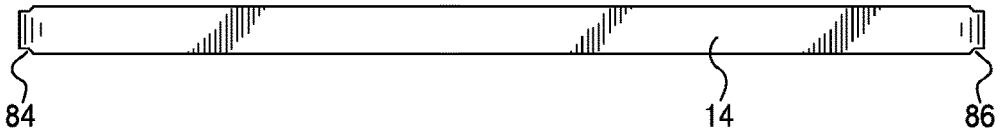
FIG. 3—is a top view showing the top edge of the sample test card of FIG. 1.
Figure 4:
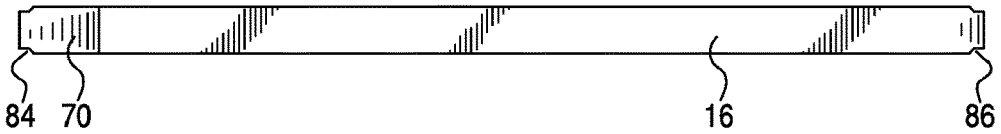
FIG. 4—is a bottom view showing the bottom edge of the sample test card of FIG. 1.
Figure 5:
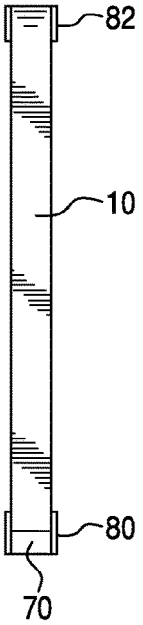
FIG. 5—is a side view showing the first or leading side edge of the sample test card of FIG. 1.
Figure 6:
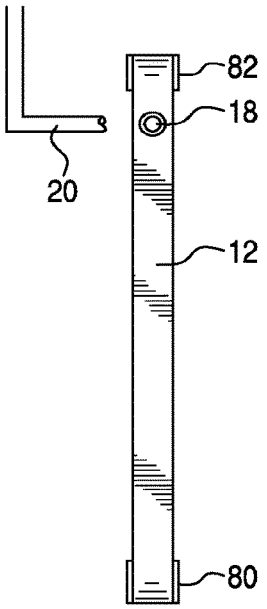
FIG. 6—is a side view showing the second or trailing side edge and intake port of the sample test card of FIG. 1.

Also, as shown in FIGS. 1-2, each of the individual sample wells 4 includes an associated bubble trap 50, connected to sample well 4 at an upper corner of the well, and located at a height slightly above the well 4 on the front card surface 6. As known in the art, each bubble trap 50 is connected to its respective well 4 by a short trap connecting conduit 52, formed as a hollow passage part-way into the card surface and forming a short conducting path for trapped gaseous bubbles which have been formed in, or communicated to, the well 4 during the injection operation, by bacterial or other biological reaction, or otherwise. Bubble trap 50 does not cut through the card completely, instead consisting of a depression or well of roughly oval or circular shape, optionally with a rounded bottom contour, and a volume of from about 2 to about 4 cubic mm in the illustrated embodiment. Because the bubble trap 50 is located at an elevated position above each respective well 4, any gaseous bubbles will tend to rise and be trapped in the depression of trap 50. With gaseous remnants led off to the bubble trap 50, analytical readings on the biological sample can be made more reliably, since scattering and other corruption of the microbial radiation reading by gas is reduced or eliminated.

For mechanical interaction with the automated reading machine, test card 2 may also be provided with a series of sensor stop holes 60, located along the uppermost edge of the card. Sensor stop holes 60, illustrated as regularly spaced, rectangular through-holes, permit associated photodetectors to detect when a test card 2 mounted in a reading machine has come into proper alignment for optical reading. In prior art cards, the sensor stop holes were arranged in vertical register with the vertical columns of wells, so that the optical detection of the stop hole corresponds exactly to positioning of the sample wells before optical reading devices. However, it has now been discovered that this precise alignment of the sensor stop holes with the leading edge of the sample wells can lead to the front edge of the well not being read as a result of a slight delay in the stopping of the card once the sensor stop holes are detected, and thus, a slight misalignment for optical reading. Accordingly, in the present embodiment, the sensor stop holes 60 are arranged in a vertical alignment slightly ahead of the vertical column of wells 4, so that one optical detection of the stop holes 60 occurs and optical reading of the test card 2 initiated, the reading will start at the front edge of the sample well 3. In accordance with this embodiment, the sensor stop holes 60 may be aligned from about 0.25 to about 2 mm ahead (i.e., closer to the first or leading edge of the test card 2) of the vertical wells 4. Moreover, aligning the sensor stop holes slightly ahead of the leading edge of the sample well enables the use of smaller sample wells since the full width of the well can be read by the optical reading machine.

Another advantage of test card 2 of the illustrated design is that patient sample and other markings are not introduced directly on the card itself, in pre-formed segments, as for example shown for example in U.S. Pat. No. 4,116,775 and others. Those on-card stipplings and markings can contribute to debris, mishandling and other problems. In the invention, instead, the card 2 may be provided with bar-coding or other data markings (not shown) by adhesive media, but markings or pre-formed information segments are not necessary (though some could be imprinted if desired) and debris, mishandling, loss of surface area and other problems can be avoided.

Test card 2 furthermore includes, at the lower left corner of the card as illustrated in FIG. 1, a tapered bezel edge 70. Tapered bezel edge 70 provides an inclined surface for easier insertion of test card 2 into, carrousels or cassettes, into slots or bins for card reading, and other loading points in the processing of the card. Tapered bezel edge 70 provides a gently inclined surface, which relieves the need for tight tolerances during loading operations.

Test card 2 also includes a lower rail 80 and an upper rail 82, which are slight structural "bulges" at along the top and bottom areas of the card to reinforce the strength and enhance handling and loading of the test card 2. The extra width of lower and upper rails 80 and 82 also exceeds the thickness of sealing material, such as adhesive tape, that is affixed to the front 6 and rear 8 surfaces of test card 2 for sealing during manufacture and impregnation with reagents. The raised rails therefore protect that tape, especially edges from peeling, during the making of the test card 2, as well as during handling of the card, including during reading operations.

As is well known in the art, upper rail 82 may have serrations (not shown) formed along its top edge, to provide greater friction when test card 2 is transported in card reading machines or otherwise using belt drive mechanisms. Also, as well known in the art, lower card rail 80 may also have formed in it reduction cavities (not shown), which are small elongated depressions which reduce the material, weight and expense of the card by carving out space where extra material is not necessary in the reinforcing rail 80.

In terms of sealing of test card 2 to contain reagents and other material, it has been noted that sealing tapes are typically used to seal flush against test card 2 from either side, with rail protection. Test card 2 may also includes a leading lip 84 on lower card rail 80, and on upper card rail 82. Conversely, at the opposite end of the test card 2 there may also be a trailing truncation 86 in both rails. This structure permits sealing tape to be applied in the card preparation process in a continuous manner, with card after card having tape applied, then the tape cut between successive cards without the tape from successive cards getting stuck together. The leading lip 84 and trailing truncation 86 provides a clearance to separate cards and their applied tape, which may be cut at the trailing truncation 86 and wrapped back around the card edge, for increased security against interference between abutting cards. Thus, the trailing truncation or slanted ramp feature 86 ends slightly inward from the extreme edge of the ends of the card, as shown in FIGS. 1 and 2 to define a portion of the card surface or "shelf portion" between the ends of the ramps 86 and the second or trailing edge 12 of the test card 2, extending across the width of the test card 2. This shelf portion provides a cutting surface for a blade cutting the tape applied to the card. Further, the ramp 86 facilitates the stacking of multiple test sample cards without scuffing of the sealant tape applied to said cards, by allowing the ramps to slide over each other during a stacking motion with the raised rails preventing scuffing of the tape.

Figure 7:
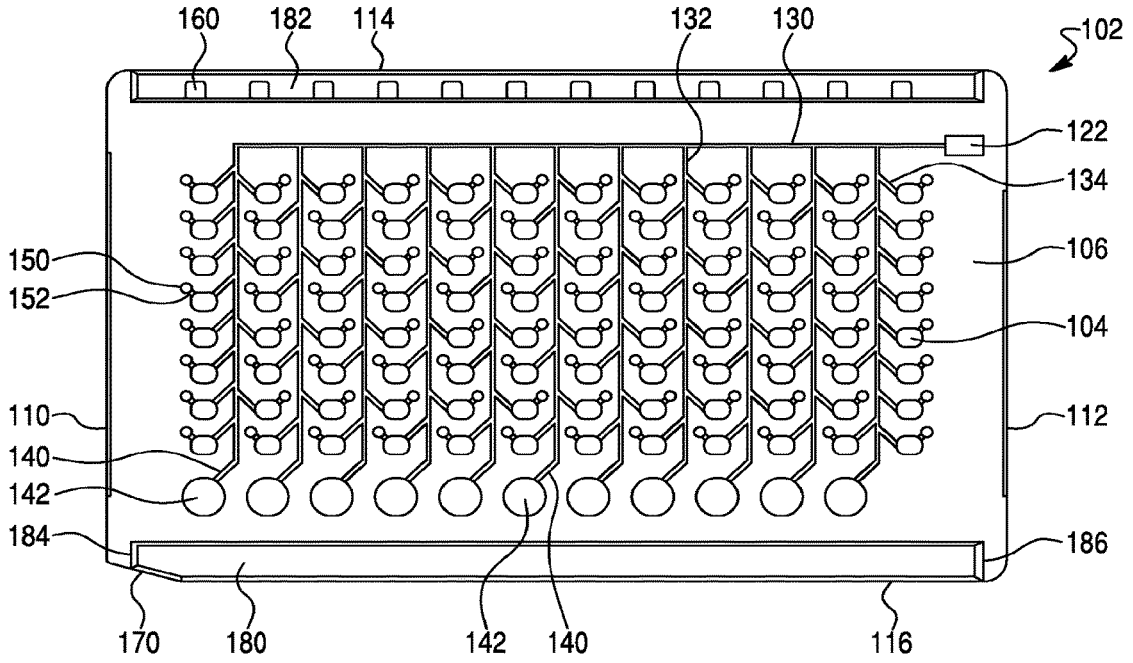
FIG. 7—is a front view of the front surface of a sample test card, in accordance with another design concept of the present invention. As shown, the sample test card comprises 96 sample wells, an intake reservoir, fluid flow distribution channels and a plurality of well ports.

Another design concept of the present invention is illustrated in FIG. 7. Like the test card shown in FIGS. 1-6, this design concept provides an improved sample test card 102, having a generally rectangular shape and in standard dimensions. The test card 102 further comprises a plurality of sample wells 104 and has a first or front surface 106 and a second or rear surface (not shown), opposite said front surface 106, a first or leading side edge 110, a second or trailing side edge 112, a top edge 114, and a bottom edge 116. The illustrated test card 102 of this embodiment contains a total of 96 individual sample wells 104, which extend completely through the test card from the front surface 106 to the rear surface (not shown), and each of which are capable of receiving a test sample for analysis, as previously described. However, test cards of this design may comprise from 80 to 140 individual sample wells, or from about 96 to about 128 individual sample wells. In one embodiment, the sample test cards may comprise 80, 88, 96, 104, 108, 112, 120, 126, 135 or 140 sample wells. The sample wells are typically arranged in a series of horizontal rows and vertical columns and may comprise from about 8 to about 10 rows of from about 10 to about 16 columns of wells. As shown in FIG. 7, the sample wells 102 can be arranged as twelve columns of eight wells 104 (i.e., 96 total sample wells).

As with the illustrated test card design shown in FIGS. 1-6, this design concept will also receive a sample fluid through an intake plenum or port (not shown), typically located on a perimeter edge. As is well known in the art, intake port receives a fluid injection tip and related assembly (not shown), through which the sample fluid or other solution which arrives to dissolve the biological reagents in each well 104 is injected, under a vacuum pulled on test card 102 (typically 0.7-0.9 PSIA), then released to atmospheric pressure. Also like the first design concept (see FIGS. 1-6), the injection port of this design will include a small intake reservoir 122 formed as a roughly rectangular hole through the test card 102, which receives incoming fluid, and acts as a fluid buffer. When the sample is injected into the card, a short segment of the sample tip can be pinched off or heat-sealed and left in place in intake port, acting as a sealing plug. After the test fluid (patient sample or other solution) enters the intake port the fluid will flow through a fluid flow path comprising a series of fluid flow channels (e.g., distribution channels and fill channels) for transport of a fluid test sample from the intake port to each of the individual sample wells, as described in more detail hereinbelow.

As shown in FIG. 7, the illustrated test card 102 employs a fluid flow path comprising a first distribution channel 130, a plurality of second distribution channels 132, and a plurality of fill channels 134, which connect to, and fill, each of the individual sample wells with a test sample. Also, as shown in FIG. 7, the illustrated test card 102 further comprises a plurality of over-flow reservoirs 142, which are operatively connected to the second distribution channels by a plurality of over-flow channels 140. As previously described herein, the over-flow channels 140 may have a reduced cross section compared to the second distribution channels 132, thereby slowing fluid flow into the over-flow reservoirs 142, and thereby ensuring that the sample wells 104 are filled. For example, in one embodiment, the over-flow channel 140 may comprises a fluid flow channel having a width of about 0.2 mm and a depth of about 0.2 mm (i.e., a cross section of approximately 0.16 $mm^2$).

As previously described hereinabove, the inclusion of one or more over-flow reservoirs on the test card allows the fluid flow path to be drained and/or filled with air, thereby creating an air barrier or air lock that reduces and/or prevents well-to-well contamination. Accordingly, by introducing an air barrier between sample wells, the long fluid flow paths between wells, required in previous card designs, can be decreased. The use of a shorter fluid flow path between wells allows for an increased well capacity within a test card having standard dimensions, while maintaining strict inter-well contamination standards. Furthermore, by reducing the well sizes of previous test card designs by approximately one-third, enough additional surface area is recovered to allow for an even greater increase in well capacity in a test card having standard dimensions.

Referring again to FIG. 7, the illustrated test card 102 of this design concept will be described in further detail. As shown in FIG. 7 the test card 102 may comprise 96 individual sample wells arranged in twelve columns of eight sample wells 104. As the test fluid (i.e., patient sample or other solution) enters intake port it collects in intake reservoir 122 and travels along a first distribution channel 130 that leads away from the intake reservoir. First distribution channel 130 comprises a relatively long channel, which extends in a substantially horizontal or widthwise manner across the front surface 106 of the test card 102, and parallel to the top edge 114 of the card. In one embodiment the first distribution channel 130 may comprises a fluid flow channel having a width of about 0.5 mm and a depth of about 0.5 mm (i.e., a cross section of approximately 0.25 $mm^2$).

First distribution channel 130 is tapped at intervals along its length by a series or plurality of second distribution channels 132, which generally descend from the first distribution channel 130 between columns of sample wells 104. As shown, for example in FIG. 7, the test card 102 may comprise 12 columns of 8 sample wells (i.e., 96 total wells). The test card 102 comprises a set of eleven total second distribution channels 132, each connected to a plurality of sample well 104 via a plurality of short fill channel 134. In one embodiment, the second distribution channels 132 may comprise a fluid flow channel having a width of about 0.2 to about 0.4 mm and a depth of about 0.3 to about 0.5 mm (i.e., a cross section of about 0.06 to 0.2 $mm^2$). In another embodiment, the second distribution channels 132 may have a width of about 0.3 mm and a depth of about 0.4 mm (i.e., a cross section of about 0.12 $mm^2$).

As shown in FIG. 7, the fill channels 134 are relatively short channels (which may be kinked) that extend at a downward angle from the second distribution channels 132 to the sample wells 104, and function to connect, and thereby fill the individual sample wells 104 of test card 102. In one embodiment, fill channels 134 may comprise a fluid flow channel having a width of about 0.2 to about 0.4 mm and a depth of about 0.3 to about 0.5 mm (i.e., a cross section of about 0.06 to 0.2 $mm^2$). In another embodiment, the fill channels 134 have a width of about 0.3 mm and a depth of about 0.4 mm (i.e., a cross section of about 0.12 $mm^2$)

Accordingly, the illustrated test card 102 (see FIG. 7) includes twelve columns each having eight sample wells, built up by connecting channels through a fluid flow path comprising the first distribution channel 130, second distribution channels 132 and fill channels 134. This provides a set of ninety-six (96) total sample wells 102 that are filled by the fluid flow path of this design concept.

As described above in relation to the first design concept (see FIGS. 1-6), the design concept illustrated in FIG. 7 may further comprise a plurality of bubble traps 150, associated with, or connected to, each of the individual sample wells 104. The test cards 102 of this design concept may also comprise a series of sensor stop holes 160, a barcode or other data marking (not shown), a tapered bezel edge 170, and/or lower and upper rails 180, 182, optionally with associated leading lip 184 or trailing truncation 186, as described in more detail hereinabove.

Figure 8:
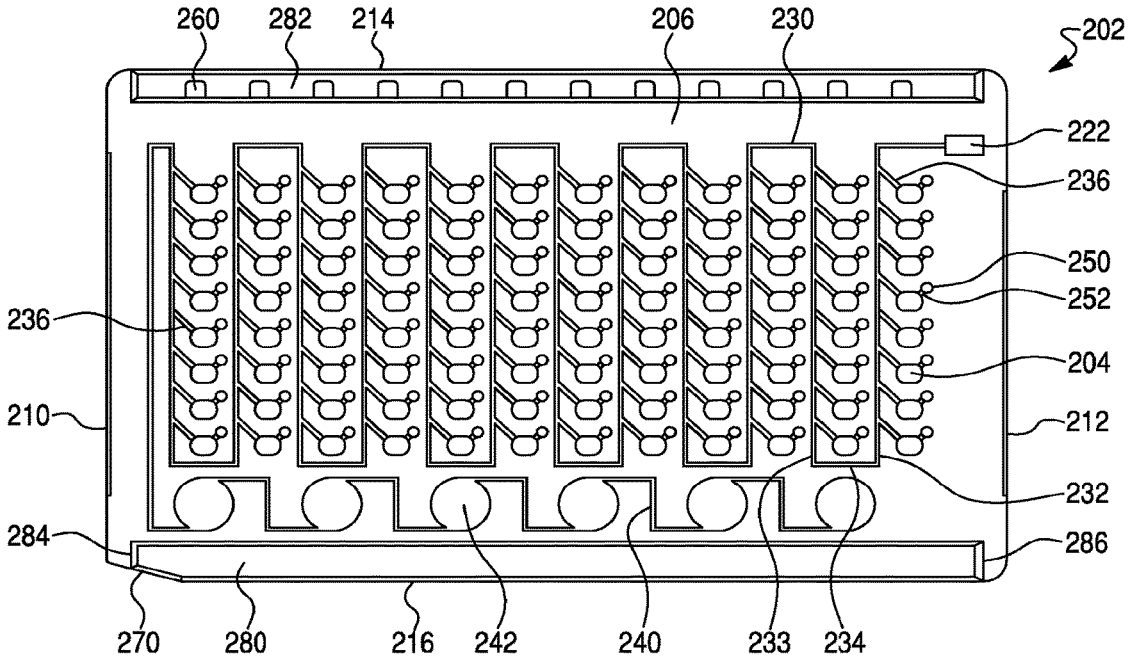
FIG. 8—is a front view of the front surface of a sample test card, in accordance with yet another design concept of the present invention. As shown, the sample test card comprises 96 sample wells, an intake reservoir, a fluid flow distribution channel and a plurality of well ports.

Yet another design concept of the present invention is illustrated in FIG. 8. Like the test card shown in FIGS. 1-6, this design concept provides an improved sample test card 202, having a generally rectangular shape and in standard dimensions. The test card 202 further comprises a plurality of sample wells 204 and has a first or front surface 206 and a second or rear surface (not shown), opposite said front surface 206, a first or leading side edge 210, a second or trailing side edge 212, a top edge 214, and a bottom edge 216. The illustrated test card 202 of this embodiment contains a total of 96 individual sample wells 204, which extend completely through the test card from the front surface 206 to the rear surface (not shown), and each of which are capable of receiving a test sample for analysis, as previously described. However, test cards of this design may comprise from 80 to 140 individual sample wells, or from about 96 to about 128 individual sample wells. In one embodiment, the sample test cards may comprise 80, 88, 96, 104, 108, 112, 120, 126, 135 or 140 sample wells. The sample wells are typically arranged in a series of horizontal rows and vertical columns and may comprise from about 8 to about 10 rows of from about 10 to about 16 columns of wells. As shown in FIG. 8, the sample wells 202 can be arranged as twelve columns of eight wells 204 (i.e., 96 total sample wells).

As with the illustrated test card design shown in FIGS. 1-6, this design concept will also receive a sample fluid through an intake plenum or port (not shown), typically located on a perimeter edge. As is well known in the art, intake port receives a fluid injection tip and related assembly (not shown), through which the sample fluid or other solution which arrives to dissolve the biological reagents in each well 204 is injected, under a vacuum pulled on test card 202 (typically 0.7-0.9 PSIA), then released to atmospheric pressure. Also like the first design concept (see FIGS. 1-6), the injection port of this design will include a small intake reservoir 222 formed as a roughly rectangular hole through the test card 202, which receives incoming fluid, and acts as a fluid buffer. When the sample is injected into the card, a short segment of the sample tip can be pinched off or heat-sealed and left in place in intake port, acting as a sealing plug. After the test fluid (patient sample or other solution) enters the intake port the fluid will flow through a fluid flow path comprising a series of fluid flow channels (e.g., distribution channels and fill channels) for transport of a fluid test sample from the intake port to each of the individual sample wells, as described in more detail hereinbelow.

As shown in FIG. 8 the illustrated test card 202 employs a fluid flow path comprising a first distribution channel 230 and a plurality of fill channels 234, which connect to, and fill, each of the individual sample wells 204 with a test sample 202. Also, as shown in FIG. 8, the illustrated test card 202 further comprises a plurality of over-flow reservoirs 242, which are operatively connected to the second distribution channels by a plurality of over-flow channels 240. As previously described herein, the over-flow channels 240 may have a reduced cross section compared to the second distribution channels 232, thereby slowing fluid flow into the over-flow reservoirs 242, and thereby ensuring that the sample wells 204 are filled. For example, in one embodiment, the over-flow channel 240 may comprises a fluid flow channel having a width of about 0.2 mm and a depth of about 0.2 mm (i.e., a cross section of approximately 0.16 $mm^2$).

As previously described hereinabove, the inclusion of one or more over-flow reservoirs on the test card allows the fluid flow path to be drained and/or filled with air, thereby creating an air barrier or air lock that reduces and/or prevents well-to-well contamination. Accordingly, by introducing an air barrier between sample wells, the long fluid flow paths between wells, required in previous card designs, can be decreased. The use of a shorter fluid flow path between wells allows for an increased well capacity within a test card having standard dimensions, while maintaining strict inter-well contamination standards. Furthermore, by reducing the well sizes of previous test card designs by approximately one-third, enough additional surface area is recovered to allow for an even greater increase in well capacity in a test card having standard dimensions.

Referring again to FIG. 8, the illustrated test card 202 of this design concept will be described in further detail. As shown in FIG. 8 the test card 202 may comprise 96 individual sample wells arranged in twelve columns of eight sample wells 204. As the test fluid (i.e., patient sample or other solution) enters intake port it collects in intake reservoir 222 and travels along a distribution channel 230 that leads away from the intake reservoir. Like the distribution channel 30 described in FIG. 1, the distribution channel 230 of this embodiment comprises a relatively long channel, which weaves across the front surface 206 of the test card 202 among a plurality of columns of sample wells 204. As shown, the distribution channel 230 extends first horizontally across the top of a first column of sample wells 204 and then vertical down the front surface 206 of the test card 204 (or descending) (i.e., descending branch 32) between parallel sets or columns of sample wells 204, each column comprising eight sample wells 204. At the bottom of the first descending branch 232, the distribution channel 230 comprises a traversing branch 234, which transverses in a horizontal manner across the surface of the card 202. The distribution channel 230 then extends vertically up (or ascends) the front surface 206 of the test card 202 (i.e., ascending branch 33) between a second set of columns of sample wells 204. At the top of the second set of sample well columns, the distribution channel 230 comprises a another traversing branch 234, which traverses in a horizontal manner across the surface of the card to the top of a third set of sample well columns and then extends vertically down or descends down (i.e., descending branch s32) between the columns of sample wells 204. This pattern of alternating descending 232 and ascending 233 branches of the distribution channel, interconnected with traversing channel branches 234, continues across the front surface 206 of the test card 202, thereby allowing the distribution channel 230 to weave between all the vertically arranged sample well columns on the test card 202. In one embodiment the first distribution channel 230 may comprises a fluid flow channel having a width of about 0.5 mm and a depth of about 0.5 mm (i.e., a cross section of approximately 0.25 $mm^2$).

As shown in FIG. 8, the fill channels 236 are relatively short channels (which may be kinked) that extend at a downward angle from the distribution channels 230 to the sample wells 204, and function to connect, and thereby fill the individual sample wells 204 of test card 202. In one embodiment, fill channels 236 may comprise a fluid flow channel having a width of about 0.2 to about 0.4 mm and a depth of about 0.3 to about 0.5 mm (i.e., a cross section of about 0.06 to 0.2 $mm^2$). In another embodiment, the fill channels 234 have a width of about 0.3 mm and a depth of about 0.4 mm (i.e., a cross section of about 0.12 $mm^2$)

Accordingly, the illustrated test card 202 (see FIG. 8) includes twelve columns each having eight sample wells, built up by connecting channels through a fluid flow path comprising the distribution channel 230 and fill channels 236. This provides a set of ninety-six (96) total sample wells 202 that are filled by the fluid flow path of this design concept.

As described above in relation to the first design concept (see FIGS. 1-6), the design concept illustrated in FIG. 8 may further comprise a plurality of bubble traps 250, associated with, or connected to, each of the individual sample wells 204. The test cards 202 of this design concept may also comprise a series of sensor stop holes 260, a barcode or other data marking (not shown), a tapered bezel edge 270, and/or lower and upper rails 280, 282, optionally with associated leading lip 284 or trailing truncation 286, as described in more detail hereinabove.

The foregoing description of the improved test cards of the invention is illustrative, and variations on certain aspects of the inventive system will occur to persons skilled in the art. The scope of the invention is accordingly intended to be limited only by the following claims.

That which is claimed is:

1. A method for filling a test sample card with a test sample, the method comprising the following steps of:

a) providing a test sample containing or suspected of containing a microorganism;

b) providing a sample test card, the sample test card comprising:

a card body defining a first surface and a second surface opposite the first surface, a fluid intake port and a plurality of sample wells disposed between the first and second surfaces;

a fluid channel network connecting the fluid intake port to the sample wells, the fluid channel network comprising at least one distribution channels, a plurality of fill channels operatively connecting the at least one distribution channel to the sample wells; and wherein the test card further comprises one or more fluid over-flow reservoirs, the over-flow reservoirs being operatively connected to the distribution channel by a fluid over-flow channel;

c) filling or loading the test sample into the sample test card via the fluid intake port;

wherein the plurality of sample wells are substantially filled with the test sample; and d) subsequently directing air or a non-aqueous liquid into the fluid channel network to reduce well-to-well contamination.

2. The method of claim 1, wherein the total volume of the test sample loaded is more than the aggregate total volume of the sample wells, and less than the total aggregate volume of the sample wells, the fluid channel network and the one or more fluid over-flow reservoirs.

3. The method of claim 1, wherein the total volume of the test sample is sufficient to fill the sample wells.

4. The method of claim 3, wherein the total volume of the test sample is sufficient to fill the fluid network and the sample wells.

5. The method of claim 4, wherein directing the air or the non-aqueous liquid into the flow channel network comprises displacing a portion of the test sample from the fluid network to the one or more fluid over-flow reservoirs.

6. The method of claim 1, wherein directing the air or the non-aqueous liquid into the flow channel network comprises displacing a portion of the test sample from the fluid network to the one or more fluid over-flow reservoirs.

7. The method of claim 1, wherein an over-flow channel connecting the distribution channel to the one or more fluid over-flow reservoirs has a reduced cross-section compared to the distribution channel, such that each of the sample wells is configured to fill with the test sample before the one or more over-flow reservoirs.

8. The method of claim 1, wherein the total volume of air aspirated into the sample test card is sufficient to fill the fluid channel network with air.

9. The method of claim 1, wherein the aspiration of air into the sample test card fills the fluid channel network with air and/or allows any excess fluid to flow into, or be captured by, the one or more fluid over-flow reservoirs.

10. The method of claim 1, wherein the test sample loaded onto the sample test card is from about 2 mL to about 3 mL.

11. The method of claim 1, wherein the test sample loaded onto the sample test card is from about 2.25 mL to about 2.75 mL.

12. The method of claim 1, wherein providing the sample test card further comprises depositing one or more reagents in the sample wells.

13. The method of claim 1, further comprising draining at least a portion of the test sample from the fluid channel network after the filling or loading the test sample into the sample test card.

14. The method of claim 1, wherein directing the air or the non-aqueous liquid into the fluid channel network comprises directing the non-aqueous liquid into the fluid channel network.

15. The method of claim 14, wherein the non-aqueous liquid is added to the test sample before the filling or loading the test sample into the sample test card.

16. The method of claim 1, wherein directing the air or the non-aqueous liquid into the fluid channel network comprises directing the air into the fluid channel network.

17. The method of claim 1, wherein the air or the non-aqueous liquid do not include the microorganism.

18. The method of claim 1, wherein the one or more fluid over-flow reservoirs further comprise an adsorbent for adsorbing excess liquid from the fluid channel network.

19. The method of claim 18, wherein the first and second surfaces sealed with a sealant tape covering the plurality of sample wells, and wherein the adsorbent is configured to bulge the sealant tape outwards to increase the volume of the adsorbent.

20. A sample test card comprising:

a card body defining a first surface and a second surface opposite the first surface, a fluid intake port and a plurality of sample wells disposed between the first and second surfaces;

a fluid channel network connecting the fluid intake port to the sample wells, the fluid channel network comprising at least one distribution channels, a plurality of fill channels operatively connecting the at least one distribution channel to the sample wells;

wherein the test card further comprises one or more fluid over-flow reservoirs, the over-flow reservoirs being operatively connected to the distribution channel by a fluid over-flow channel;

wherein the sample test card is configured to receive a test sample via the fluid intake port, such that the plurality of sample wells are substantially filled with the test sample;

wherein the sample test card is subsequently configured to receive air or a non-aqueous liquid in the fluid channel network.

21. The sample test card of claim 20, wherein the one or more fluid over-flow reservoirs are configured to receive a portion of the test sample from the fluid channel network when the air or the non-aqueous liquid is received by the sample test card.

22. The sample test card of claim 20, wherein each of the sample wells defines a volume that is less than a volume of the one or more fluid over-flow reservoirs.

23. The sample test card of claim 20, wherein the sample wells further include a reagent deposited therein.

24. The test card of claim 20, further comprising a bubble trap in fluid communication with each of the sample wells, the traps being positioned at least partly above the respective wells.

25. The test card of claim 24, wherein the bubble traps include an opening on the first surface of the sample test card and do not extend to the second surface of the sample test card.

26. The test card of claim 24, wherein the one or more fluid over-flow reservoirs do not include the bubble trap.

* * * * *